US007878324B2

(12) United States Patent
Bellamah et al.

(10) Patent No.: US 7,878,324 B2
(45) Date of Patent: Feb. 1, 2011

(54) POCKET-SIZE CONTAINER FOR CONSUMER ITEMS

(75) Inventors: Stephen J. Bellamah, Midlothian, VA (US); William T. Griffin, Chesterfield, VA (US); Dominic J. C. Howard, New Canaan, CT (US); Robert T. Mitten, Glen Allen, VA (US)

(73) Assignee: Philip Morris USA Inc., Richmond, VA (US)

( * ) Notice: Subject to any disclaimer, the term of this patent is extended or adjusted under 35 U.S.C. 154(b) by 15 days.

(21) Appl. No.: 12/292,607

(22) Filed: Nov. 21, 2008

(65) Prior Publication Data

US 2009/0250360 A1 Oct. 8, 2009

Related U.S. Application Data

(60) Provisional application No. 61/004,764, filed on Nov. 30, 2007.

(51) Int. Cl.
*A24F 23/00* (2006.01)
*B65D 6/28* (2006.01)

(52) U.S. Cl. ..... 206/236; 206/37; 206/242; 220/4.27; 220/685

(58) Field of Classification Search ..... 206/38–38.1, 206/236, 242–269, 37; 220/4.21–4.24, 4.26–4.28, 220/4.31–4.32, 315, 324, 377, 780–795, 220/503, 504, 681, 685
See application file for complete search history.

(56) References Cited

U.S. PATENT DOCUMENTS 411,773 A 10/1889 Atkinson
663,415 A 12/1900 Charles
1,072,820 A 9/1913 Carnes
2,023,341 A * 12/1935 Stuchbery et al. ..... 220/787
2,062,542 A * 12/1936 Warren ..... 220/231
2,412,528 A * 12/1946 Morrell ..... 220/681
2,523,251 A 9/1950 Pantalone et al.
3,042,247 A 7/1962 Bonnet (Continued)

FOREIGN PATENT DOCUMENTS

CA 2547369 A1 11/2007

(Continued)

OTHER PUBLICATIONS

Partial International Search Report dated Oct. 13, 2008 for PCT/IB2008/001836.

(Continued)

*Primary Examiner*—Bryon P Gehman
(74) *Attorney, Agent, or Firm*—Buchanan Ingersoll & Rooney PC

(57) ABSTRACT

A three-piece pocket-size container for holding a consumer product such as smokeless tobacco product in an interior volume of a perimeter band which has a base locked to a lower rim portion and an openable cover on an upper rim of the perimeter band. When closed, the cover, the perimeter band and the base form a flush exterior sidewall of the container. The base and cover can be metal and the perimeter band can be transparent (clear, tinted or colored) or opaque plastic to provide a container that maintains product freshness, and is easily opened and closed.

23 Claims, 6 Drawing Sheets

U.S. PATENT DOCUMENTS

| | | | | |
|---|---|---|---|---|
| 3,206,016 | A | | 9/1965 | Fowle et al. |
| 3,790,018 | A | * | 2/1974 | Farkas ..... 220/4.27 |
| 3,894,654 | A | | 7/1975 | Frankenberg |
| 3,913,774 | A | * | 10/1975 | Vajtay ..... 220/315 |
| 4,098,421 | A | | 7/1978 | Foster |
| 4,190,170 | A | | 2/1980 | Boyd |
| 4,440,307 | A | | 4/1984 | Bartels et al. |
| 4,646,933 | A | | 3/1987 | Jurczenia et al. |
| 4,715,496 | A | | 12/1987 | Hackmann |
| 4,804,101 | A | * | 2/1989 | Heath ..... 206/38 |
| 4,850,504 | A | | 7/1989 | Gindrod et al. |
| 4,955,531 | A | | 9/1990 | Graboyes |
| 5,143,282 | A | | 9/1992 | Pham |
| D341,482 | S | | 11/1993 | McMillan |
| 5,259,526 | A | | 11/1993 | Stolzman |
| 5,341,925 | A | | 8/1994 | Fleenor et al. |
| 5,460,287 | A | | 10/1995 | Cargile et al. |
| 5,478,011 | A | | 12/1995 | Pham |
| 5,676,272 | A | | 10/1997 | Baerenwald |
| 5,782,371 | A | | 7/1998 | Baerenwald et al. |
| 5,791,473 | A | | 8/1998 | Decker et al. |
| 5,794,814 | A | | 8/1998 | Baerenwald |
| 5,871,116 | A | * | 2/1999 | Picchietti ..... 220/4.24 |
| 6,138,687 | A | * | 10/2000 | Sheffler et al. ..... 220/504 |
| D448,668 | S | | 10/2001 | Baerenwald et al. |
| D456,713 | S | | 5/2002 | Bried et al. |
| D462,613 | S | | 9/2002 | Bried et al. |
| D464,567 | S | | 10/2002 | Baerenwald et al. |
| D469,607 | S | | 2/2003 | Wolff |
| D474,402 | S | | 5/2003 | Baerenwald |
| D481,867 | S | | 11/2003 | Hotz |
| 6,732,873 | B2 | | 5/2004 | Bried et al. |
| D494,474 | S | | 8/2004 | Houk et al. |
| D512,636 | S | | 12/2005 | Pace |
| D514,936 | S | | 2/2006 | Pace et al. |
| D515,426 | S | | 2/2006 | Pace et al. |
| D515,429 | S | | 2/2006 | Pace |
| D515,439 | S | | 2/2006 | Pace |
| D515,928 | S | | 2/2006 | Pace |
| D518,728 | S | | 4/2006 | Frantz |
| D523,752 | S | | 6/2006 | Bried et al. |
| D531,036 | S | | 10/2006 | Bried et al. |
| D536,614 | S | | 2/2007 | Peterson et al. |
| D541,176 | S | | 4/2007 | Bried |
| 2003/0153446 | A1 | | 8/2003 | Focke et al. |
| 2004/0144661 | A1 | | 7/2004 | Lutzig |
| 2006/0060480 | A1 | | 3/2006 | Budd |
| 2006/0101564 | A1 | | 5/2006 | Powdermaker |
| 2006/0118589 | A1 | | 6/2006 | Arnarp et al. |
| 2006/0283721 | A1 | | 12/2006 | Kutsch et al. |
| 2007/0012711 | A1 | | 1/2007 | Kutsch et al. |
| 2007/0110928 | A1 | | 5/2007 | Bried et al. |
| 2007/0130811 | A1 | | 6/2007 | Shevelev et al. |

FOREIGN PATENT DOCUMENTS

| | | | |
|---|---|---|---|
| CH | 694145 | A5 | 8/2004 |
| DE | 4103612 | A1 | 8/1992 |
| DE | 4109702 | A1 | 9/1992 |
| EP | 0434962 | A1 | 7/1991 |
| EP | 0900736 | A2 | 3/1999 |
| GB | 1004671 | A | 9/1965 |
| GB | 2032887 | | 5/1980 |
| WO | WO00/43289 | | 7/2000 |

OTHER PUBLICATIONS

International Search Report and Written Opinion mailed Feb. 23, 2009 for PCT/EP2008/010056.

International Preliminary Report on Patentability mailed Jun. 10, 2010 by The International Bureau of WIPO in corresponding International Application No. PCT/EP2008/010056.

* cited by examiner

POCKET-SIZE CONTAINER FOR CONSUMER ITEMS

CROSS-REFERENCE TO RELATED APPLICATION

This application claims benefit of the filing date of U.S. Provisional Application Ser. No. 61/004,764 filed Nov. 30, 2007, the entire content of which is incorporated herein by reference.

SUMMARY

According to an embodiment, provided is a pocket-size container for use with consumer products, which includes a perimeter band having a protruding bulwark forming a first sidewall portion of the container. The perimeter band has an upper rim portion above the protruding bulwark to accept a cover and a lower rim portion below the protruding bulwark to accept a base. A pan-shaped rigid base having an upward wall surrounding the lower rim portion of the perimeter band forms a second sidewall portion of the container below and flush with the protruding bulwark of the perimeter band. A pan-shaped rigid cover having a downward wall surrounding the upper rim portion of the perimeter band forms a third sidewall portion of the container above and flush with the protruding bulwark of the perimeter band when the container is closed. The perimeter band includes a locking mechanism preventing release of the base from the perimeter band.

According to another embodiment, provided is a method of packaging smokeless tobacco products, including machine stamping a pan-shaped base having a bottom joined to an upward wall and machine curling an upper edge on the upward wall inwardly to form an inwardly curled edge, injection molding a plastic perimeter band having an upper rim portion to accept a cover and a lower rim portion to snugly line an interior of the base upward wall, and a protruding bulwark between the upper and lower rim portions, the perimeter band having a plurality of protrusions around a periphery of an exterior of the lower rim portion to engage and permanently lock the curled upper edge on the upward wall, pressing the perimeter band lower rim portion into the base until the inwardly curled edge expands over the protrusions and snaps into a gap between the protrusions and the bulwark, at least partially filling a space within the perimeter band with smokeless tobacco product, covering the upper rim portion of the perimeter band with a cover having a downward wall that fits snugly around the upper rim portion with a parting line between opposed edges of the downward wall and the protruding bulwark of the perimeter band, sealing the parting line with a tear strip to form a pocket-size container.

According to another embodiment, provided is a method of packaging smokeless tobacco products, including machine stamping a pan-shaped base having a bottom joined to an upward wall and machine curling an upper edge on the upward wall inwardly to form an inwardly curled edge, injection molding a one piece plastic tray including a perimeter band having an upper rim portion to accept a cover, a lower rim portion to snugly line an interior of the base upward wall, a tray bottom to line an interior of the base bottom, and a protruding bulwark between the upper and lower rim portions, the perimeter band having a plurality of protrusions around a periphery of an exterior of the lower rim portion to engage and permanently lock the curled upper edge on the upward wall, at least partially filling the tray with smokeless tobacco product, covering the tray with a membrane sealed to a periphery of the interior space at an upper edge of the upper rim, pressing the perimeter band lower rim portion into the base until the inwardly curled edge expands over the protrusions and snaps into a gap between the protrusions and the bulwark, covering the upper rim portion of the perimeter band with a cover having a downward wall that fits snugly around the upper rim portion with a parting line between opposed edges of the downward wall and the protruding bulwark of the perimeter band, and sealing the parting line with a tear strip to form a pocket-size container.

DETAILED DESCRIPTION

As described herein, an embodiment of a pocket-size container has a perimeter band (i.e., collar) forming a central sidewall portion of the container, a pan shaped base with an upward vertical wall forming a lower sidewall portion and bottom of the container and a pan shaped cover with a downward vertical wall to close the container and form an upper sidewall portion and a lid of the container. Preferably, the central sidewall portion, the lower sidewall portion and, when the container is closed, the upper sidewall portion, form a smooth, planar surface which circumscribes the container. In another embodiment of the container, the perimeter band may be formed integrally with a tray to line the bottom of the base.

Preferably, the perimeter band has an upper vertical rim portion projecting above a protruding bulwark to receive an interior surface of the vertical wall of the cover to frictionally close the container. The protruding vertical bulwark forms the central sidewall portion of the container. Preferably, the perimeter band has another rim portion, a lower vertical rim portion, below the protruding vertical bulwark, to connect to the base along an interior of the vertical wall of the base. As used herein, the vertical walls or rim portions refer to a substantially vertical orientation, however embodiments are not limited thereto, for example, the vertical walls and/or the vertical rim portions may be smooth, continuous curves and/or at an angle to vertical.

Preferably, the perimeter band provides a seamless exterior surface which circumscribes the container. The perimeter band provides a secure mechanical connection with the base and a releasable snap fit or frictional fit with the cover such that the cover and base are supported only by the perimeter band. The container preferably contains consumer items within an interior volume defined by the space within the perimeter band.

The perimeter band provides a rigid upstanding wall having a high strength such that the container has a high torsional stability when the cover is removed. In a preferred embodiment, the perimeter band provides a sealable opening at the upper end thereof for a hermetic seal. Preferably, the perimeter band provides a surface for smooth opening and closing of the container. In an embodiment where the perimeter band is plastic, the rattle or grating noise of metal contacting metal can be avoided.

Preferably, at least one of the central sidewall portion, the lower sidewall portion, the upper sidewall portion and a combination thereof provides a planar circumferential panel for a label. The label is not particularly limited and can be an onsert, sticker, printed adhesive film, printed shrink fit film, embossing, painting and/or printing directly on the panel, or combinations thereof.

Figure 1A:
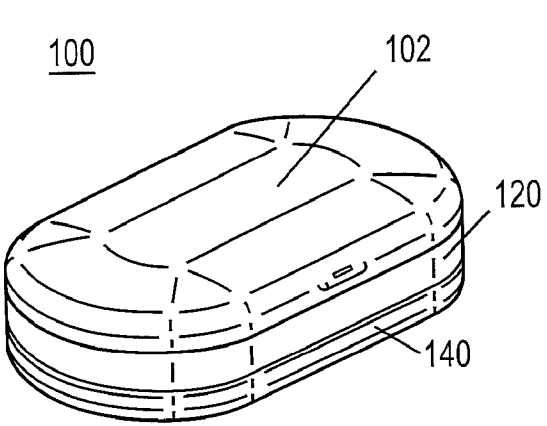
FIGS. 1A-1D show an embodiment of a container having a rounded corner shape, a cover having a dome top, a base having a dome bottom and a continuous perimeter band non-integral with the base and connected to the base, having a protruding bulwark to form the container sidewall flush with a vertical wall of the base and a vertical wall of the cover when the container is closed.
Figure 1B:
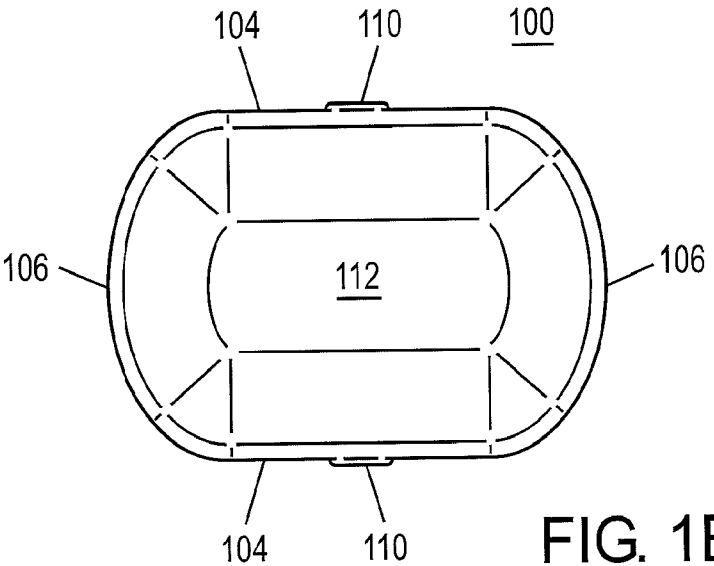

FIGS. 1A-1D show a preferred embodiment of the pocket-size container. FIG. 1A shows a partial isometric view where a perimeter band 120 is attached to a rigid base 140 and lidded by a rigid cover 102. Referring to FIG. 1B, in this embodiment, the container 100 has a rounded corner shape with parallel long sides 104 (i.e., straight walls) and short curved ends 106 (i.e., end walls). The radius of curvature of the ends 106 is preferably between half a width of the container, where the container width is the distance between the long sides 104, and 90% of the width of the container. More preferably, the radius of curvature is between 50 to 60% of the width. The length of the container 100 is a distance between the center of one curved end and the center of the other curved end. Preferably, the width of the container is 50 to 80% of the length of the container. More preferably, the width of the container is between 60 and 65% of the length.

Figure 1C:
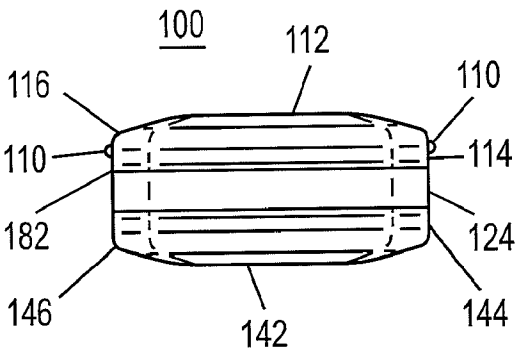

As shown in FIGS. 1A-1D, preferably, the container cover 102 has a ridge 110 to act as a thumb or finger grasp point for removing the lid. Preferably the container cover 102 can be removed by a cam action. Optionally, the container cover 102 can be hinged (not shown) to the perimeter band 120. One ridge 110 is shown centrally located at the top of each long side 104 of the downward wall 114 of the container cover 102, however the location of the ridge 110 and the number of ridges is not particularly limited. An end view of the container 100 shown in FIG. 1C illustrates the perimeter band 120 forming a first central sidewall portion 124 of the container 100. The base 140 has a dome shaped bottom 142 joined to upward wall 144 by a rounded corner 146. Upward wall 144 is preferably, flush with the first sidewall portion 124 and forms a second (lower) sidewall portion of the container. The top 112 of the cover 102 is dome shape according to this embodiment, and is joined to a downward wall 114 by a rounded corner 116. The downward wall 114 forms a third (upper) portion of the container sidewall and is preferably flush with the first portion 124.

Figure 1D:
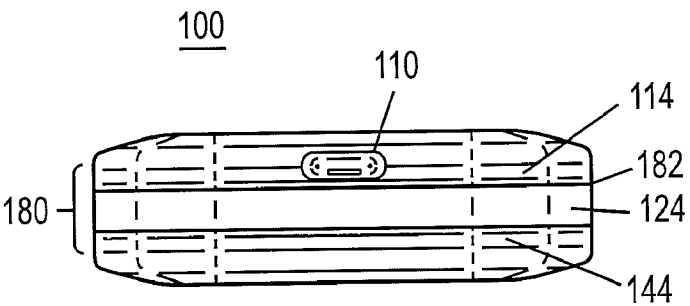

A side view of the closed container 100 shown in FIG. 1D illustrates a flush container sidewall 180 and a parting line 182 where a lower edge of the downward wall 114 separates from an upper shelf of the perimeter band 120 when the container 100 is opened. In an embodiment, the cover 102 and base 140 can be of one material and the perimeter band 120 can be of a second material. In a preferred embodiment, the cover 102 and base 140 are metal and the perimeter band 120 is plastic. Preferably, the perimeter band 120 is transparent plastic (clear or various see through colors such as yellow, green, blue, red, etc.) providing a window through which the contents of the container 100 may be viewed.

Figure 2:
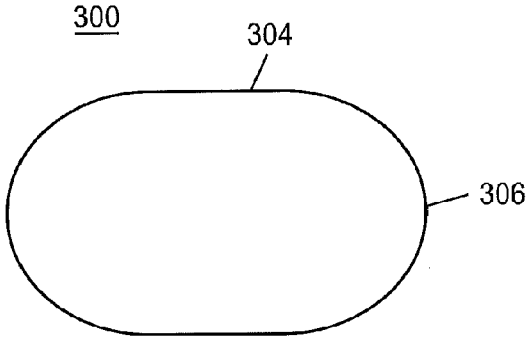
FIG. 2 shows another embodiment of a container having a rounded corner shape resembling a racetrack.
Figure 3A:
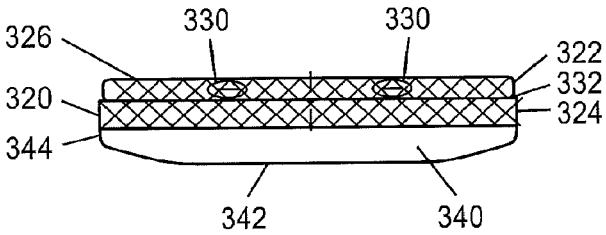
FIGS. 3A and 3B show side views of a long side and a short side, respectively, of another embodiment of a base of a rounded corner container having a dome bottom and a continuous perimeter band non-integral with the base and captured in the base, the collar having a protruding bulwark to form the container sidewall flush with the base vertical wall and an upper rim portion for receiving a first membrane and cover vertical wall to close the container.
Figure 3B:
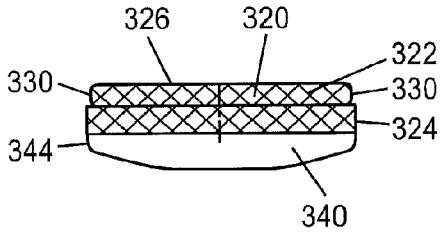

FIG. 2 shows another embodiment of a rounded corner container 300 having spaced apart parallel long sides 304 and spaced apart curved ends 306. FIGS. 3A and 3B show a side view and end view of another embodiment of a container 300 with the cover removed, having a base 340 which has a dome bottom 342 and an upward wall 344. The upward wall 344 attaches the perimeter band 320 to the base 340. Preferably, an upper edge of the upward wall 344 is connected to a lower rim portion of the perimeter band 320 (See FIG. 7A).

In a preferred embodiment, the perimeter band 320 is mechanically secured to the base 340. Preferably, the perimeter band 320 is secured to the base 340 by a machine curl on the base as described later with reference to FIG. 7A. Also, preferably, no adhesives or glues are used to aid in securing the perimeter band 320 to the base 340, but such adhesives may be used if desired. Preferably, the perimeter band 320 is secured such that the bottom of the perimeter band 320 makes a firm contact or is adjacent to an inside surface of the bottom 342 of the base 340 at a periphery to maximize the space enclosed by the perimeter band 320 to utilize for consumer product storage. In an embodiment where a tray is integrally formed with the perimeter band 320, preferably, the bottom of the tray contacts or is adjacent to the inside surface of the bottom 342 of the base 340.

In an embodiment of the container 300, the perimeter band 320, with or without the integral tray, can be molded in place with the lower rim portion molded in the container base 340. Preferably, the perimeter band 320 is molded in place such that the bottom of the perimeter band 320 makes a firm contact against a periphery of an inside surface of the bottom 342 of the base 340 to maximize the space enclosed by the perimeter band 320 to utilize for consumer product storage.

The perimeter band 320 has a protruding bulwark 324 which forms a flush container sidewall with the upward wall 344. Above the protruding bulwark an upper rim portion 322 extends from an upper shelf 332 of the perimeter band 320. The upper edge 326 of the upper rim portion 322 fits within a downward wall of a cover, as described above, and the upper edge 326 can accept a foil or membrane to form a hermetic seal (See FIG. 7B) which can then be covered by a container cover. According to the embodiment shown in FIGS. 3A and 3B, the upper rim portion 322 can have small protrusions 330 to releasably attach the cover to the perimeter band which prevents unintentional opening of the container 300.

Figure 4A:
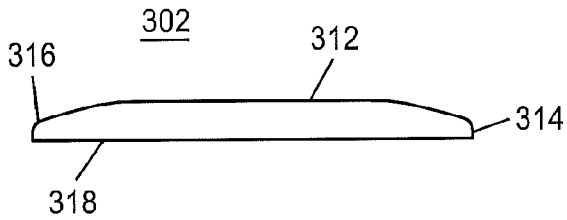
FIGS. 4A and 4B show side views of a long side and a short side, respectively, of another embodiment of a cover of a rounded corner container having a dome top and a vertical wall to fit over a perimeter band to close a container.
Figure 4B:
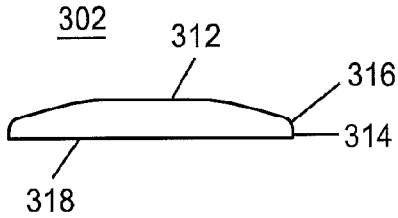

FIGS. 4A and 4B show a side view and end view of another embodiment of a container cover 302 removed from the container 300, having a dome top 312 connected to a downward sidewall 314 by a rounded corner 316. The downward wall 314 surrounds an upper rim portion of a perimeter band to close the container 300, as described above. Preferably, a lower edge of the downward wall 318 is releasably attached by the upper rim portion of the perimeter band to close the container 300 (See FIG. 7A). The upper rim portion can engage the lower edge by such structures as a friction interference fit between the upper rim portion and downward wall 314, a snap ring on the upper rim portion over which the lower edge 318 having an inwardly rolled edge passes, protrusions on the upper rim portion and/or on the downward wall 314, etc.

Figure 5A:
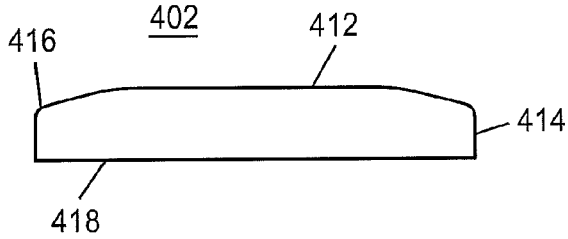
FIGS. 5A and 5B show side views of a long side and a short side, respectively, of another embodiment of a cover of a rounded corner container having a dome top and a vertical wall to fit over a perimeter band to close a container.
Figure 5B:
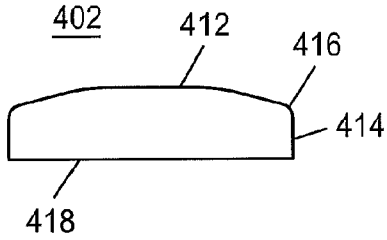
Figure 6A:
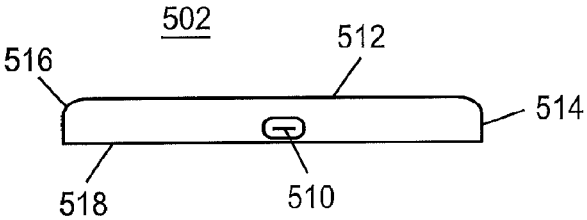
FIGS. 6A and 6B show side views of a long side and a short side, respectively, of another embodiment of a cover of a rounded corner container having a flat top and a vertical wall to fit over a perimeter band to close a container.
Figure 6B:
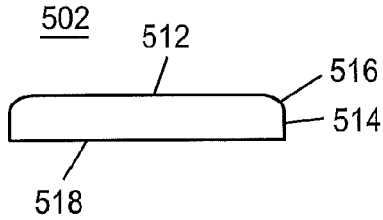

FIGS. 5A and 5B illustrate a side view and end view of another embodiment of a container cover 402 removed from the container 300, having a dome top 412 connected to a downward sidewall 414 by a rounded corner 416. The downward wall 414 extends further to the lower edge 418 than in the previous embodiment shown in FIGS. 4A and 4B. A side view and end view of another embodiment of a container cover 502 removed from the container 300, having a flat top 512 connected to a downward sidewall 514 by a rounded corner 516 are shown in FIGS. 6A and 6B. In this embodiment, the flat top 512 is substantially parallel to the lower edge 518. Between the lower edge 518 and the flat top 512 of the cover 502, a ridge 510 is shown on downward wall 514 to facilitate the lidding operation during packaging of a consumer product in the container 300 and/or opening and closing of the container 300 by a user. The embodiments of covers 302, 402 and 502, are preferably machine drawn or stamped sheet metal.

Figure 7A:
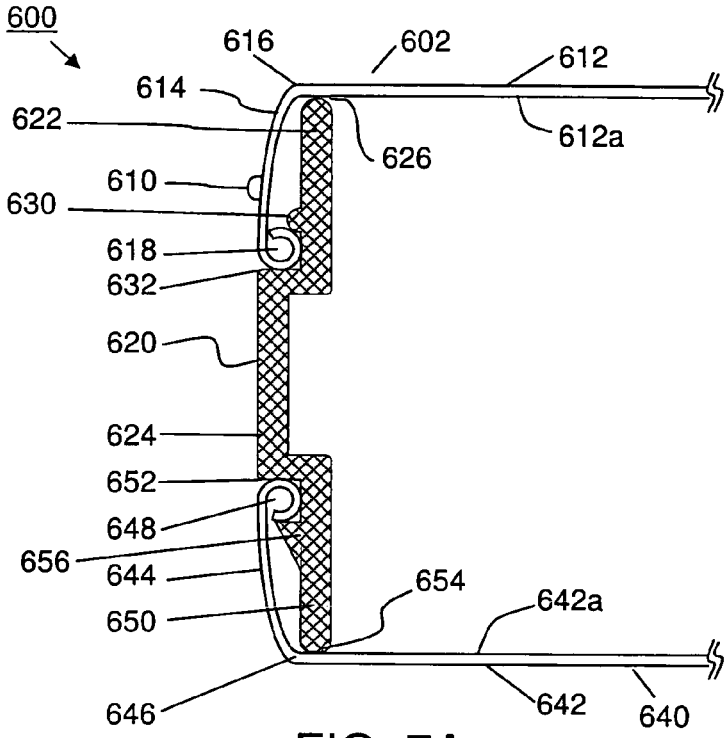
FIG. 7A shows a cross-section through a closed container according to another embodiment, in which the container has a cover having a flat top, a base having a flat bottom and a continuous perimeter band non-integral with the base and connected to the base, the perimeter band has a protruding bulwark to form the container sidewall flush with a vertical wall of the base and a vertical wall of the cover when the container is closed.
Figure 7B:
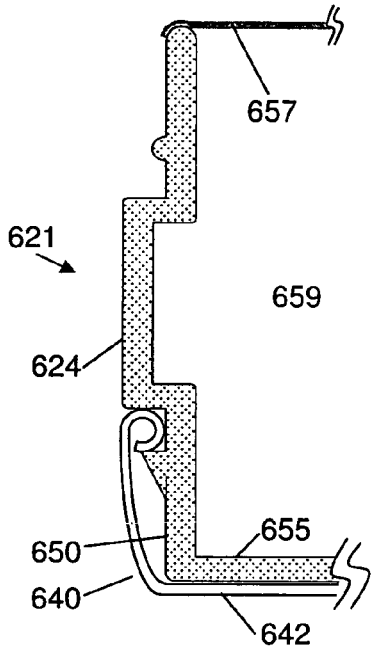
FIG. 7B shows a cross-section through a closed container according to another embodiment, in which the perimeter band non-integral with the base, has a tray bottom to line a bottom of the base and a first membrane sealed to an upper edge of an upper rim portion.

Referring to FIGS. 7A and 7B, details of an embodiment of the perimeter band 620 will now be described. In FIG. 7A, a cross section of the perimeter band 620 is shown connecting a base 640 to a cover 602. The base 640 has a bottom 642 connected to an upward wall 644 at a rounded corner 646. An upper edge of the upward wall 644 has an inwardly curled edge 648 (e.g., rolled up portion of sidewall), which is mechanically clamped between a locking protrusion 656 on a lower rim portion 650 of the perimeter band 620 and a lower shelf 652 of the perimeter band to prevent release of the base 642 when attached to the perimeter band 620. A flat surface of the locking protrusion 656 prevents the base 640 from being manually removed from the perimeter band 620 while clamping the inwardly curled edge 648 to the lower shelf 652. Preferably, the upward wall 644 fits securely around the lower rim portion 650 and a lower edge 654 of the lower rim portion 650 engages an interior surface of the bottom 642*a*. Although the locking protrusion 656 is shown and described as having a flat surface engaging the curled edge 648, the locking protrusion 656 is not so limited and could have a concave curved surface or a surface slanted upward in a direction away from the external surface of the lower rim portion 650 to prevent release of the base from the perimeter band.

In the embodiment shown, the upward wall 644 is bowed into the lower rim portion 650 to lock the base 640 to the perimeter band 620 with a spring action of the upward wall 644 biasing the base 640 into the lower rim portion 650 providing a planar circumferential outside container sidewall for supporting a membrane seal and/or a label. Optionally, the perimeter band 620 and the perimeter band with an integral tray 621 can be molded in place in the base 640.

The lower shelf 652 connects the lower rim portion 650 to a protruding bulwark 624 of the perimeter band 620. The inwardly curled edge 648 is clamped to the lower shelf 652 such that the upward wall 644 and the protruding bulwark 624 form a flush sidewall of the container 600. The C-beam of the protruding bulwark 624 secured to the container base 640 as described, provides strength and stability to the container 600 according to this embodiment. According to other embodiments, the protruding bulwark 624 can be an I-beam, H-beam, X-beam, Box-beam or other cross sectional shape. In an embodiment, the perimeter band has a smooth inner wall without an inner recess.

As shown in FIG. 7A, the cover 602 has a top 612 connected to a downward wall 614 by a rounded corner 616. The lower edge of the downward wall 614 has an inwardly curled edge 618 (e.g., rolled up portion of sidewall) which is releasably engaged between one or more small protrusions 630 on an upper rim portion 622 of the perimeter band 620 and an upper shelf 632 of the perimeter band. The small protrusions 630 are shown as curved surfaces engaging the curled edge 618, however the small protrusions 630 are not particularly limited and can be of various size and shape. The one or more small protrusions 630 prevent the cover 602 from unintentionally being removed from the perimeter band 620 while also allowing the cover 602 to be removed from the container 600 when intentional finger pressure is applied by a user on a ridge 610, as previously described with reference to FIGS. 3A and 3B. When the cover 602 is closed over the upper rim portion 622 of the perimeter band 620, the one or more small protrusions 630 engage the inwardly curled edge 618 to the upper shelf 632. Preferably, the downward wall 614 fits securely around the upper rim portion 622 and an upper edge 626 of the upper rim portion 622 engages an interior surface of the top 612*a*.

According to an embodiment, the plurality of small protrusions 630 can circumscribe the upper rim portion 622 to releasably attach a lower inwardly curled edge 618 of the container cover 602. In another embodiment, the plurality of small protrusions 630 can be located only at curved ends 306 (FIG. 2) of the upper rim portion 622 or a plurality of small protrusions 630 can be located only along the long sides 304 (FIG. 2) of the upper rim portion 622. In still another embodiment, a single ring, such as a snap ring (not shown) can circumscribe the upper rim portion 622 exterior surface to releasably attach a lower inwardly curled edge 618 of the container cover 602. Preferably, two small protrusions 630 on each long side 304 (See FIG. 3A) of the upper rim portion 622 provide a secure cover 602 closure. Optionally, the container cover can be hinged to the perimeter band 620 on one long side 304 and small protrusions 630 on the other long side 304 of the upper rim portion 622 provide a secure cover 602 closure.

FIG. 7B shows a cross section of another embodiment of a perimeter band 621, which has a tray portion 655 lining the bottom 642 of the container base 640. In a preferred embodiment, the perimeter band 620/621 is made of transparent plastic which functions as a window for a consumer to observe the contents of the container through the window. Also in a preferred embodiment, a first membrane 657 hermetically seals to the upper edge 626 of the perimeter band 621, thereby hermetically sealing consumer products within an interior space 659 defined by the perimeter band 621. The first membrane 657 is not particularly limited and may be foil, plastic, a combination thereof or a composite thereof. The first membrane 657 can be breathable or non-breathable. Preferably, the first membrane 657 has a pull tab (not shown) for removing the first membrane 657 by a user. The pull tab can be a thumb-sized overlap of the first membrane 657 pressed down along a portion of the upper rim portion.

A breathable membrane can transmit gas, vapor and/or water through the membrane. Breathable membranes comprise natural and synthetic materials of a porous nature, for example, a woven material or a membrane having perforations. A non-breathable material provides a hermetic seal and does not allow gas, vapor or water to pass through the membrane.

Figure 8:
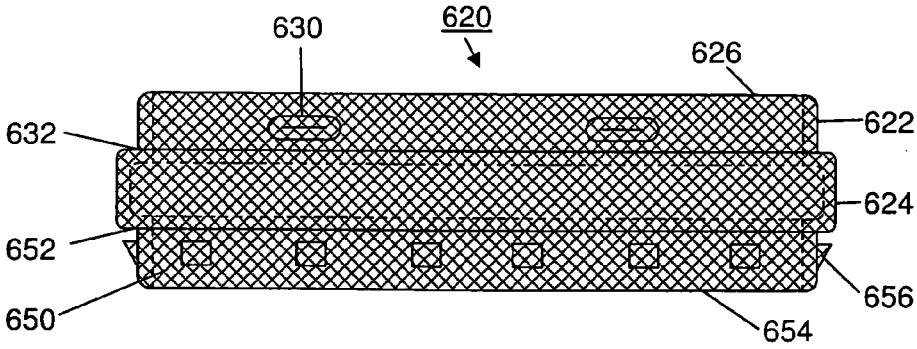
FIG. 8 shows a side view of a long side of an embodiment of a perimeter band.

FIG. 8 shows a side view of the embodiment of a perimeter band 620 shown in FIG. 7A. A plurality of locking protrusions 656 is shown on the lower rim portion 650. According to a preferred embodiment, locking protrusions 656 can circumscribe the lower rim portion 650 to engage an upper inwardly curled edge 648 of a container base 640 clamped to a lower shelf 652 of the perimeter band 620. In another embodiment, locking protrusions 656 can be located only at curved ends of the lower rim portion 650 or can be located only along the long sides of the lower rim portion 650. In still another embodiment, a locking protrusion single ring (not shown) can circumscribe the lower rim portion 650 exterior surface to engage the upper inwardly curled edge 648 of the container base 640 clamped to the lower shelf 652 of the perimeter band 620. In an embodiment of a rounded rectangular container (FIG. 2) having straight side walls 304 and curved end walls 306, the lower rim portion 650 of the perimeter band 620, preferably, has four locking projections 656 along each straight wall 304 and six locking projections 656 along each curved wall 306 and the upper rim portion 622, preferably, has two small projections 630 along each straight wall 304 and no small projections 630 along each curved wall 306.

In an embodiment, the thickness of the pocket-size container cover 602 and base 640 is in a range of about 0.1 to 0.40 mm (e.g., about 0.2-0.3 mm or 0.22-0.28 mm) and the inwardly curled edges 648/618 of the base and cover have respective thicknesses in a range of about 0.3 to 2.5 mm (e.g., 0.4-2, 0.5-1.5, 0.6-0.8 mm). In an embodiment, the protruding bulwark 624 of the perimeter band 620 protrudes beyond the upper and lower rim portions 622/650 of the perimeter band 620 by the respective thicknesses of the inwardly curled edges 648/618 such that the cover 602, base 640 and perimeter band 620 form a flush container sidewall 180 as previously described (for example, with reference to FIGS. 1A-1D). In an embodiment, the thickness of the pocket-size container perimeter band 620 is in a range of about 0.5 to 2.5 mm (e.g., 1-2 mm or 1.2-1.8 mm). Similarly, for an embodiment where the pocket size container perimeter band 621 has an integral tray portion 655, the thickness of the pocket-size container perimeter band 621 and tray portion 655 is in a range of about 0.5 to 2.5 mm (e.g., 1-2 mm or 1.2-1.8 mm). The thicknesses of the protruding bulwark 624, upper rim portion 622, lower rim portion 650 and tray portion 655 are not required to be the same and may all vary within an embodiment of a single perimeter band 620/621 or may all be the same. For example, the pocket size container can have a cover 602 of stamped sheet metal about 0.22-0.24 mm (e.g., about 0.23 mm) thick having a curled edge 618 which is 0.7-0.8 mm (e.g., about 0.75 mm) thick, a base 640 of stamped sheet metal about 0.22-0.24 mm (e.g., about 0.23 mm) thick having a curled edge 648 which is 0.7-0.8 mm (e.g., about 0.75 mm) thick, and a perimeter band 620/621 of about 1.3-1.6 mm (e.g., about 1.5 mm) thick plastic.

Figure 9A:
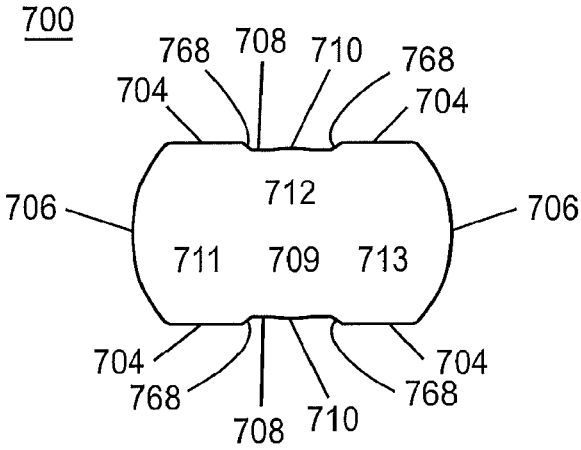
FIGS. 9A-9D show another embodiment of a container having a rounded corner shape with indents in the long sides, a cover having a dome top, a base having a dome bottom and a continuous perimeter band non-integral with the base, the perimeter band connected to the base and having a protruding bulwark to form the container sidewall flush with a vertical wall of the cover and a vertical wall of the base.

FIGS. 9A to 9D show another preferred embodiment of the container 700. Referring to FIG. 9A, in this embodiment, the container 700 has first and second wide end sections 711/713 (e.g., rounded end sections) spaced apart and separated by a narrow midsection 709 (e.g., a rectangular center section). The wide end sections 711/713 have parallel sides 704 and curved ends 706. The radius of curvature of the ends 706 is preferably between half a width of the container, where the container width is the distance between the long sides 704, and 90% of the width of the container. More preferably, the radius of curvature is between 50 to 60% of the width. The length of the container 700 is a distance between the center of one curved end and the center of the other curved end. Preferably, the width of the container is 50 to 80% of the length of the container. More preferably, the width of the container is between 60 and 65% of the length.

According to this embodiment, the narrow midsection 709 has indented parallel sides 708 and flared sections 768 to connect the narrow midsection 709 to the wide end sections 711/713. Such a shape of the rounded corner container 700 is referred to as a waist shape.

Figure 9B:
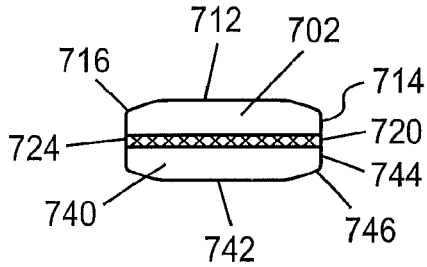

As shown in FIGS. 9A-9D, preferably, the waist shape container cover 702 has a ridge 710 to act as a thumb or finger grasp point for removing the lid. One ridge 710 is shown on each indented side 708 of the downward wall 714 of the container cover 702, however the location of the ridge 710 and the number of ridges is not particularly limited. An end view of the container 700 shown in FIG. 9B illustrates the perimeter band 720 forms a first sidewall portion 724 of the container 700. The base 740 has a dome shaped bottom 742 joined to upward wall 744 by a rounded corner 746. Upward wall 744 is preferably, flush with the first sidewall portion 724 and forms a second sidewall portion of the container. The top 712 of the cover 702 is dome shape according to this embodiment, and is joined to a downward wall 714 by a rounded corner 716. The downward wall 714 forms a third portion of the container sidewall and is preferably flush with the first portion 724.

Figure 9C:
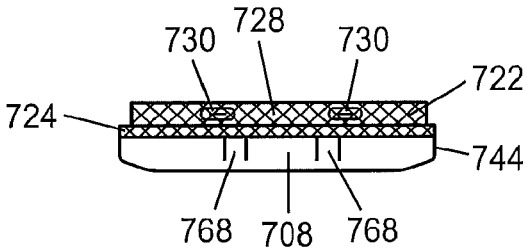

FIG. 9C shows a side view of the waist container 700 with the cover 702 removed. The indented parallel sides 708 and flared sections 768 to connect the narrow midsection 709 to the wide end sections 711/713 can be seen in the perimeter band 720 and base 740 such that the container 700 has a flush vertical sidewall. The perimeter band 720 and the base bottom 742 have a waist shape to substantially match the top 712.

Figure 9D:
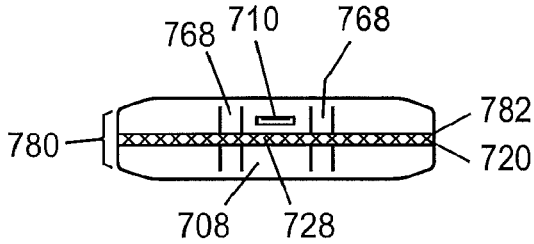

A side view of the closed container 700 shown in FIG. 9D illustrates a flush container sidewall 780 and a parting line 782 where a lower edge of the downward wall 714 separates from an upper shelf of the perimeter band 720 when the container 700 is opened. Just as in the previous embodiments, the cover 702 and base 740 can be of one material and the perimeter band 720 can be of a second material. In a preferred embodiment, the cover 702 and base 740 are stamped sheet metal and the perimeter band 720 is of molded plastic. Preferably, the perimeter band 720 is transparent plastic (clear or various see through colors such as yellow, green, blue, red, etc.) providing a window through which the contents of the container 700 may be viewed. Preferably, the container sidewall 780 is a smooth vertical surface circumscribing the container to provide a panel for a label (e.g., a printed adhesive film, printed shrink fit film, printing directly on the container sidewall 780, embossing, etc.).

In a preferred embodiment, the outside of the container cover and/or base will be pre-printed and treated with a protective scratch resistant textured material such as a polymer coating. Preferably, the inside of the container cover and base will be treated with a corrosion-resistant coating such as an epoxy coating for corrosion protection. Although not preferred, the cover and/or the base may have a top and bottom recessed panel. Such a recessed panel is provided to allow for a label (e.g., embossing, adhesive or shrink fit labeling, ink jet printing, onserting, and other similar applications).

In a preferred embodiment, the top of the perimeter band is tapered to allow easy positioning or alignment of the cover inwardly curled edge around the top of the upper rim portion and to make a snug closure of the container when the cover and base are squeezed towards each other. The perimeter band preferably contacts the bottom of the base and the top of the cover when the cover is closed to utilize the space within the perimeter band for consumer items and/or provide a sealable surface.

In a preferred embodiment, the downward wall of the cover extends downward from the top and the upward wall of the base extends upward a distance in a range of 15% to 45% of the distance from the top to the bottom when the cover closes the container, and the protruding bulwark of the perimeter band extends a distance in a range of 10% to 70% of the distance from the top to the bottom when the cover closes the container. Also preferably, the downward wall and upward wall are of an equal height. Thus, the parting line between the cover and the perimeter band upper shelf is located such that the container height partitioned to the cover is noticeably less than the remainder of the container height partitioned to the protruding bulwark of the perimeter band and the base. Such a preferred split ratio is proportioned to indicate to a user an upright position during cover removal with the thinner cover (lid) being oriented above the base. However, the split ratio can have any other desired value. For example, the container may have a split ratio in a range of 70% to 30% of the container height partitioned to the cover height and correspondingly 30% to 70% partitioned to the protruding bulwark and base height. In an embodiment, the split ratio can also be selected to achieve a certain desired internal volume consistent with the amount of product to be stored in the container. For example, the container can be about 20-24 mm high, e.g., 22 mm high, about 45-55 mm wide, e.g., 50 mm wide, and have about a 75-85 mm length, e.g., a 80 mm length. In such an embodiment, the cover height can be about 5-10 mm, e.g., 7 mm, and the protruding bulwark and base height can be about 12-19 mm, e.g., 15 mm.

In an embodiment, the pocket-size container is about 30 mm to about 80 mm in width, about 60 to about 110 mm in length, and about 15 mm to about 40 mm in height. In an embodiment of the pocket-size container having a waist shape, the narrow section (e.g., rectangular center section) width can be about 3 to about 20 mm less than the wide sections (e.g., rounded end sections) where the wide sections are about 30 mm to about 80 mm in width. The waist shape container is about 60 to 110 mm in length, where the narrow section is about 15 to about 45 mm in length, the flared sections can be about 3 to about 15 mm in length each, and the container can be about 15 mm to about 40 mm in height. In a preferred embodiment, the container fits in the palm of an adult user's hand or in a pocket. Most preferably, the size of the interior volume is determined based on the amount of product to be enclosed.

In an embodiment, the perimeter band is a single piece of injection molded plastic such as low density polyethylene resin. Suitable plastics include, without limitation, polypropylene, polyethylene, polystyrene, nylon, polysulfone, polyester, polyurethane, and combinations thereof. Because some plastics absorb flavors, the preferred plastic is polypropylene if the enclosed product includes flavors.

In one embodiment, the cover and base are formed of a metal stamping. Suitable metals, include without limitation aluminum, aluminum alloys, steels, stainless steel alloys, titanium, titanium alloys, magnesium, magnesium alloys, tin, tin alloys, copper, copper alloys, brasses, and combinations thereof. The cover and base are preferably identical in shape, height and width of the inwardly curled edge.

Preferably, the perimeter band provides a seal to the container cover. Preferably, the perimeter band facilitates removing the cover and replacing the cover to open and close the container. Also preferably, the surface of the flush container sidewall formed by the protruding bulwark of the perimeter band and the upward sidewall of the base provides a planar circumferential panel for a label. Also preferably, when the container is closed, the perimeter band, the upper side wall of the base and the downward sidewall of the cover provide a planar circumferential panel for a label.

Figure 10:
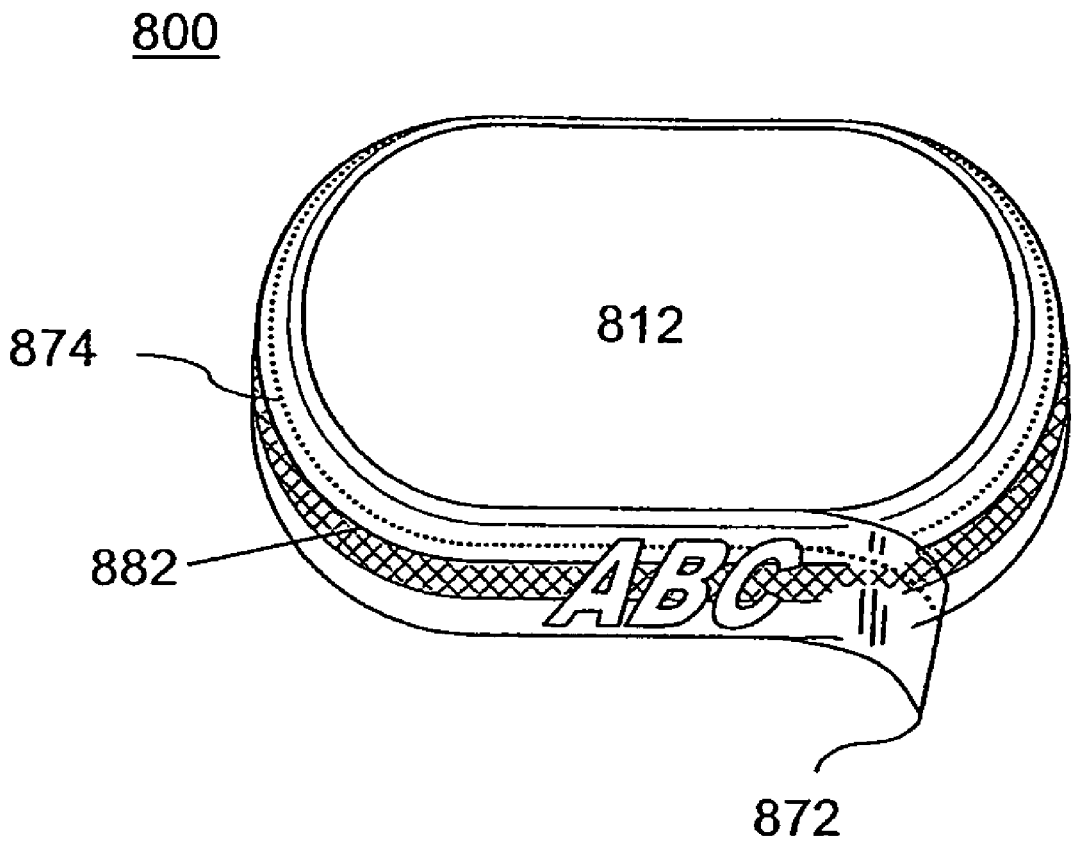
FIG. 10 illustrates an embodiment of a perforated label around a periphery of an embodiment of a container.

In an embodiment shown in FIG. 10, a second membrane seal 872 surrounds the periphery of the container 800. In this embodiment, the container 800 has a shape to match a rounded corner top 812, but the container 800 shape is not so limited and can have other shapes as discussed above. The second membrane 872 overlaps the parting line seam 882 between the cover and the perimeter band upper shelf. Preferably, the second membrane seal 872 is a pressure sensitive clear label applied to the surface of the container sidewall. Optionally, a tape wrapped around the periphery of the container for tamper prevention may be used as the second membrane seal 872. Also preferably, the second membrane seal 872 may be used as a tamper evident seal. Also preferably, the membrane material may be polypropylene. While the second membrane seal 872 is preferably polypropylene, the second membrane seal 872 may be other suitable materials such as heat shrinkable polyolefin film. The second membrane seal 872 can be breathable or non-breathable.

In a preferred embodiment, the second membrane seal is perforated 874 to allow for appropriate container breatheability. Also preferably, the second membrane seal 872 covers the circumference of the container and is positioned to center such perforations 874 across the parting line 882 of the cover and perimeter band upper shelf when the container 800 is closed. The use of a perforated second membrane 872 improves the ability to open the container 800. In use, the consumer breaks the seal at the perforation 874 prior to opening the container 800. In another embodiment, the second membrane seal 872 includes a pull tab (not shown) that is engaged to break the seal of the second membrane 872 and provide access to the contents of the container 800. The parting line 882 position can be as shown by perforations 874, or higher or lower. Likewise, the perforations 874 can be as shown or higher or lower.

The second membrane seal 872 preferably has a plurality of horizontal sections (not shown) separated by perforations 874. For example, an upper section separated from a mid section by a first row of perforations, and a lower section separated from the mid section by a second row of perforations. Preferably, an inner surface of the upper section is bonded to the cover downward wall and an inner surface of the lower section is bonded to the perimeter band protruding bulwark and base upward wall, such that the container can be opened after the mid section is removed by breaking perforations. In such an embodiment the mid section is known as a tear-off strip of a tamper evident seal. Preferably, the inner surfaces of upper and lower sections are bonded to the container sidewall portions by a pressure sensitive adhesive.

While the inner surfaces of upper and lower sections are preferably bonded to the container sidewall portions, the upper and lower sections may also be not bonded such that the membrane seal may optionally be completely removed when the tear-off strip is severed or when the perforation 874 is broken. For example, the second membrane seal 872 can be shrink fit to the periphery of the container optionally covering the sidewall, the sidewall and portions of the top and/or bottom, or the entire container 800. In such an embodiment, the second membrane 872 may be completely removed from the container 800 after the tear-off strip (not shown) is removed or after the perforation 874 is broken.

Although not limited, the second membrane seal 872 may be 10-30 mm wide. Preferably 15 mm wide. The upper and lower sections may each be 2-7 mm wide and the mid section width may be 1-8 mm wide. Preferably, the mid section is 6 mm wide and the upper and lower sections are each 3 mm wide.

Assembly of the container 600 is very simple. Referring to FIGS. 7A and 7B, the lower rim portion 650 of the perimeter band 620/621 is inserted into the upward wall 644 of the base 640 and pressed down until the upper edge 648 of the base 640 is snapped over the one or more locking protrusions 656 of the lower rim portion 650. The cover 602 can be installed on the upper rim portion 622 of the perimeter band 620. Optionally, the perimeter band 620/621 can be molded in place.

In use, a consumer grips the underside of the container 600 in the palm of his/her hand, while lifting the cover 602 away from the perimeter band 620 to expose the consumer products stored within the interior volume 659. Preferably, the user applies a camming motion to separate the cover 602 from the perimeter band 620. Optionally, the user applies a camming motion to open a hinged cover. The base 640 is locked to the perimeter band 620/621 such that it will not come off when a user applies sufficient force to remove the cover 602. Preferably, the base 642 can not be detached from the perimeter band 620/621 by a user using only hand pressure.

The particular dimensions and proportions of the container are not critical. The proportions are preferably selected to provide a container which is sized to accommodate the particular items to be packaged therein. Thus, the actual container could be more elongated than shown in the drawings, or the container could be more nearly square or deeper than shown in the drawings. Preferably, however, the container is sized so it can be conveniently carried in a pocket, and held in a hand and opened by a consumer.

The items can be arranged in various ways. For example, the products could be arranged with the items overlapped or staggered relative to one another. Of course, if the products are small enough, they could be randomly placed in the interior volume.

The container could, of course, be used for a variety of products. One specific product for which the container can be used is smokeless pouched tobacco. Such tobacco can be provided in packets, sometimes known as "snus" and comprise individual packets of tobacco material. Another specific product for which the container can be used is moist smokeless tobacco (MST).

When the container is used for snus, the first membrane 657 provides a hermetic seal to maintain the product freshness and the second membrane 872 can be perforated or non-perforated. Optionally, when the container is used for snus, the first membrane 657 can be omitted and the second membrane 872 can be non-perforated to provide a hermetic seal.

When the container is used for moist smokeless tobacco (MST), preferably the product can breathe, e.g., off-gas, through any membrane(s) used. When the first membrane 657 and/or second membrane 872 is used in the container with moist smokeless tobacco, the first membrane and/or second membrane preferably comprises breathable material.

It will be appreciated from the foregoing that there is provided an inexpensive pocket-size container capable of holding multiple items, and capable of being held and opened by a consumer.

It should be understood that the foregoing description is of the preferred embodiments, and is, therefore, merely representative of the article and methods of manufacturing the same. It can be appreciated that variations and modifications of the different embodiments in light of the above teachings will be readily apparent to those skilled in the art. For example, the perimeter band may have a bottom portion to line the bottom of the base, the perimeter band may have a hollow wall, or the shape of the container may vary from rounded corner and waist to other shapes, such as cuboid or other polyhedron with smoothly rounded corners. Accordingly, exemplary embodiments, as well as alternative embodiments, may be made without departing from the spirit and scope of the articles and methods as set forth in the attached claims.

We claim:

1. A pocket-size container for use with consumer products, comprising:

a perimeter band having a protruding bulwark forming a first sidewall portion of the container, having an upper rim portion above the protruding bulwark to accept a cover and a lower rim portion below the protruding bulwark to accept a base;

a pan-shaped rigid base having an upward wall surrounding the lower rim portion of the perimeter band forming a second sidewall portion of the container below and flush with the protruding bulwark of the perimeter band; and a pan-shaped rigid cover having a downward wall surrounding the upper rim portion of the perimeter band forming a third sidewall portion of the container above and flush with the protruding bulwark of the perimeter band when the container is closed;

wherein an outermost wall surface of the first sidewall portion is flush with an outermost wall surface of the second sidewall portion and an outermost wall surface of the third sidewall portion;

wherein the perimeter band includes a locking mechanism preventing release of the base from the perimeter band.

2. The pocket-size container for use with consumer products of claim 1, wherein the perimeter band is one of transparent, translucent, tinted, pigmented and opaque.

3. The pocket-size container for use with consumer products of claim 1, wherein a lower edge of the lower rim portion of the perimeter band is one of closely adjacent or and contacting a bottom of the base and an upper edge of the upper rim portion of the perimeter band is one of closely adjacent or and contacting a top of the cover.

4. The pocket-size container for use with consumer products of claim 1, wherein the perimeter band is incorporated in a one-piece tray which lines a bottom of the base.

5. The pocket-size container for use with consumer products of claim 4, wherein the tray contains tobacco pouch products and an upper edge of the perimeter band is hermetically sealed with a membrane.

6. The pocket-size container for use with consumer products of claim 1, wherein the container is a three-piece container consisting of the cover, base and perimeter band, the base is a metal sheet stamping with a curled upper edge, the cover is a metal sheet stamping with a curled lower edge, and the perimeter band is brightly colored and see-through plastic.

7. The pocket-size container for use with consumer products of claim 6, wherein the perimeter band is a single piece of injection molded plastic of a material selected from the group consisting of polypropylene, polyethylene, polystyrene, nylon, polysulfone, polyester, polyurethane, and combinations thereof.

8. The pocket-size container for use with consumer products of claim 6, further comprising a corrosion resistant coating on at least one of the interior of the base and the interior of the cover.

9. The pocket-size container for use with consumer products of claim 1, wherein:

the base includes two straight sidewalls and two curved endwalls which join a domed bottom of the base in a rounded corner or an abrupt corner with a smooth radius;

the sidewall portions are substantially vertical;

the cover includes two straight sidewalls and two curved endwalls which join a domed top of the cover in one of a rounded corner and an abrupt corner with a smooth radius.

10. The pocket-size container for use with consumer products of claim 9, wherein the lower rim of the perimeter band includes two straight walls and two curved endwalls with spaced apart projections on the straight walls and curved walls, the locking mechanism comprises the spaced apart protrusions engaging the straight walls and the curved walls of the base, and the base and cover are identical in size and shape.

11. The pocket-size container for use with consumer products of claim 1, wherein the locking mechanism comprises:

a plurality of protrusions on an exterior surface of the lower rim portion of the perimeter band which lock an upper inwardly curled edge of the upward wall of the base such that the curled edge is clamped between the protruding bulwark and the protrusions.

12. The pocket-size container for use with consumer products of claim 11, wherein the upper inwardly curled edge is clamped only along upper and lower surfaces and an inwardly facing surface.

13. The pocket-size container for use with consumer products of claim 1, wherein the cover is hinged to the perimeter band.

14. The pocket-size container for use with consumer products of claim 1, further comprising:

a label on at least one of an exterior surface of the base, an exterior surface of the perimeter band, an exterior surface of the cover, and a combination thereof; and a scratch resistant textured coating on the exterior and/or interior surfaces of the base and the cover.

15. The pocket-size container for use with consumer products of claim 1, wherein:

the downward wall of the cover extends downward from the top and the upward wall of the base extends upward from the bottom a distance in a range of 15% to 45% of the distance from the top to the bottom when the cover closes the container, and the protruding bulwark of the perimeter band extends a distance in a range of 10% to 70% of the distance from the top to the bottom when the cover closes the container.

16. The pocket-size container for use with consumer products of claim 1, wherein the base is of sheet metal and an upper edge of the base comprises an inwardly curled portion of the sheet metal, the locking mechanism including a flat surface engaging the curled portion.

17. The pocket-size container for use with consumer products of claim 1, wherein the cover is of sheet metal and a lower edge of the cover comprises an inwardly curled portion of the sheet metal, the cover being removably secured to the perimeter band by a curved surface engaging the curled portion.

18. The pocket-size container for use with consumer products of claim 17, wherein the perimeter band comprises a sidewall of a tray fitted in the base.

19. The pocket-size container for use with consumer products of claim 1, further comprising at least one of:

a first membrane sealed to a periphery of the interior space at an upper edge of the perimeter band;

a second membrane covering a parting line around a periphery of the container, the parting line formed between the downward wall of the cover and an upper edge of the protruding bulwark when the container is closed;

wherein the first and second membranes comprise one of breathable or non-breathable natural or synthetic material, foil, plastic, polypropylene, polyolefin, composites thereof, pressure sensitive, shrink-fit, and combinations thereof.

20. The pocket-size container for use with consumer products of claim 19, wherein at least one of the first membrane comprises a pull tab to remove the first membrane from the upper edge of the perimeter band and the second membrane comprises a tamper evident pull tab used to break the second membrane for opening the container.

21. The pocket-size container for use with consumer products of claim 1, wherein:

the base includes a rectangular center section and rounded end sections wherein the rounded end sections are wider than the center section;

the sidewall portions are substantially vertical;

the cover includes a rectangular center section and rounded end sections wherein the rounded end sections are wider than the center section;

wherein the cover comprises a dome top or a flat top and the base comprises a dome bottom or flat bottom.

22. The pocket-size container for use with consumer products of claim 1, wherein the perimeter band is translucent and the interior volume contains a plurality of consumer products which can be viewed through the perimeter band.

23. The pocket-size container for use with consumer products of claim 22, wherein the consumer products are smokeless tobacco pouches or moist smokeless tobacco (MST).

* * * * *